US010843352B2

(12) United States Patent
Cunningham

(10) Patent No.: US 10,843,352 B2
(45) Date of Patent: Nov. 24, 2020

(54) CUTTING TOOL WITH A FLAT FORCE PROFILE

(71) Applicant: Fiskars Finland Oy Ab, Helsinki (FI)

(72) Inventor: Daniel Cunningham, Prairie du Sac, WI (US)

(73) Assignee: Fiskars Finland Oy Ab, Helsinki (FI)

( * ) Notice: Subject to any disclaimer, the term of this patent is extended or adjusted under 35 U.S.C. 154(b) by 0 days.

(21) Appl. No.: 15/781,356

(22) PCT Filed: Dec. 9, 2015

(86) PCT No.: PCT/US2015/064764
§ 371 (c)(1),
(2) Date: Jun. 4, 2018

(87) PCT Pub. No.: WO2017/099760
PCT Pub. Date: Jun. 15, 2017

(65) Prior Publication Data

US 2018/0354145 A1 Dec. 13, 2018

(51) Int. Cl.
*B26B 13/06* (2006.01)
*B26B 13/28* (2006.01)

(52) U.S. Cl.
CPC ..... *B26B 13/06* (2013.01); *B26B 13/28* (2013.01)

(58) Field of Classification Search
CPC ..... B26B 13/06; B26B 13/28
USPC ..... 30/254
See application file for complete search history.

(56) References Cited

U.S. PATENT DOCUMENTS 639,874 A * 12/1899 Thuillier
2,269,587 A * 1/1942 Hardin ..... B26B 13/06 30/254
2,676,402 A * 4/1954 Shaler ..... B26B 13/10 30/230
3,055,107 A * 9/1962 Carlberg ..... A01G 3/0251 30/254

(Continued)

FOREIGN PATENT DOCUMENTS

JP H10-225581 8/1998
JP 3151253 U 6/2009

(Continued)

OTHER PUBLICATIONS

English translation of FR 1 001 351, publication date Feb. 22, 1952.*

(Continued)

*Primary Examiner* — Hwei-Siu C Payer
(74) *Attorney, Agent, or Firm* — Foley & Lardner LLP

(57) ABSTRACT

Various embodiments disclosed herein related to a hand operated cutting tool. The hand operated cutting tool may include a first cutting member; a first handle coupled to the first cutting member; a second handle having a second cutting member; and a pivot connection pivotably coupling the first handle to the second handle. The first cutting member may include a cutting device that defines a bow-shaped cutting profile, wherein the bow-shaped cutting profile facilitates an acceleration of a cut-point position defined by an interaction of the first and second cutting members as the first and second handles move from a fully open position to a fully closed position.

7 Claims, 6 Drawing Sheets

(56) References Cited

U.S. PATENT DOCUMENTS

| | | | | |
|---|---|---|---|---|
| 4,567,656 | A * | 2/1986 | Wallace | B26B 13/16 30/262 |
| 4,901,440 | A * | 2/1990 | Go | A01G 3/02 30/233 |
| 6,024,744 | A | 2/2000 | Kese et al. | |
| 8,079,150 | B2 * | 12/2011 | Huang | B26B 13/16 30/254 |
| 9,345,200 | B2 * | 5/2016 | Cunningham | A01G 3/0251 |
| 2012/0047745 | A1 * | 3/2012 | Wu | A01G 3/02 30/146 |
| 2013/0000131 | A1 | 1/2013 | Savolainen et al. | |
| 2013/0305543 | A1 | 11/2013 | Yonetsu et al. | |
| 2014/0053413 | A1 * | 2/2014 | Huang | A01G 3/0251 30/250 |
| 2014/0290071 | A1 | 10/2014 | Yoshida | |
| 2015/0047209 | A1 * | 2/2015 | Schmidt | B26B 13/28 30/233 |
| 2018/0354145 | A1 * | 12/2018 | Cunningham | B26B 13/06 |

FOREIGN PATENT DOCUMENTS

| | | |
|---|---|---|
| JP | 5712118 | 5/2015 |
| WO | WO 96/35557 | * 11/1996 |

OTHER PUBLICATIONS

International Search Report and Written Opinion for International Application No. PCT/US2015/064764, dated Feb. 9, 2016, 6 pages.

* cited by examiner

CUTTING TOOL WITH A FLAT FORCE PROFILE

FIELD

The present disclosure relates to hand operated cutting tools. More particularly, the present disclosure relates to hand operated cutting tools.

BACKGROUND

Hand operated cutting tools are used in a variety of applications (e.g., pruning or trimming branches and the like). Some hand operated cutting tools may include devices intended to increase the available leverage (e.g., levers and/or gears) to increase a force provided by the tool to the cut an object. However, such mechanisms are typically large, which increase weight and complexity to the tool. Such large mechanisms are especially undesirable in smaller hand operated cutting tools, such as pruners, where users desire light-weight and ease of maneuverability.

SUMMARY

One embodiment relates to a hand operated cutting tool. The hand operated cutting tool includes a first cutting member; a first handle coupled to the first cutting member; a second handle having a second cutting member; and a pivot connection pivotably coupling the first handle to the second handle. According to one embodiment, the first cutting member includes a cutting device that defines a bow-shaped cutting profile, wherein the bow-shaped cutting profile facilitates an acceleration of a cut-point position defined by an interaction of the first and second cutting members as the first and second handles move from a fully open position to a fully closed position.

Another embodiment relates to a scissors. The scissors includes a first cutting member having a first cutting device, wherein the first cutting device defines a bow-shaped cutting profile; a first handle coupled to the first cutting member; a second cutting member having a second cutting device; a second handle coupled to the second cutting member; and a pivot connection pivotably coupling the first handle to the second handle, wherein the first and second handles are movable between a fully open position and a fully closed position. According to one embodiment, a substantial linear cut force profile exists as the first and second handles move from the fully open position to the fully closed position.

Still another embodiment relates to a one-hand operated cutting tool. The one-hand operated cutting tool includes a first cutting member having a first cutting device, wherein the first cutting device defines a bow-shaped cutting profile; a first handle coupled to the first cutting member; a second cutting member having a second cutting device, wherein the second cutting devices a bow-shaped cutting profile; a second handle coupled to the second cutting member; and a pivot connection rotatably coupling the first handle to the second handle, wherein the first and second handles are movable between a fully open position and a fully closed position, wherein in the fully open position the first and second handles are at a maximum separation distance and in the fully closed position the first and second handles are a minimum separation distance. According to one embodiment, movement of the handles from the fully open position to the fully closed position results in a substantially linear cut force relationship for the one-hand operated cutting tool.

DETAILED DESCRIPTION

Figure 1:
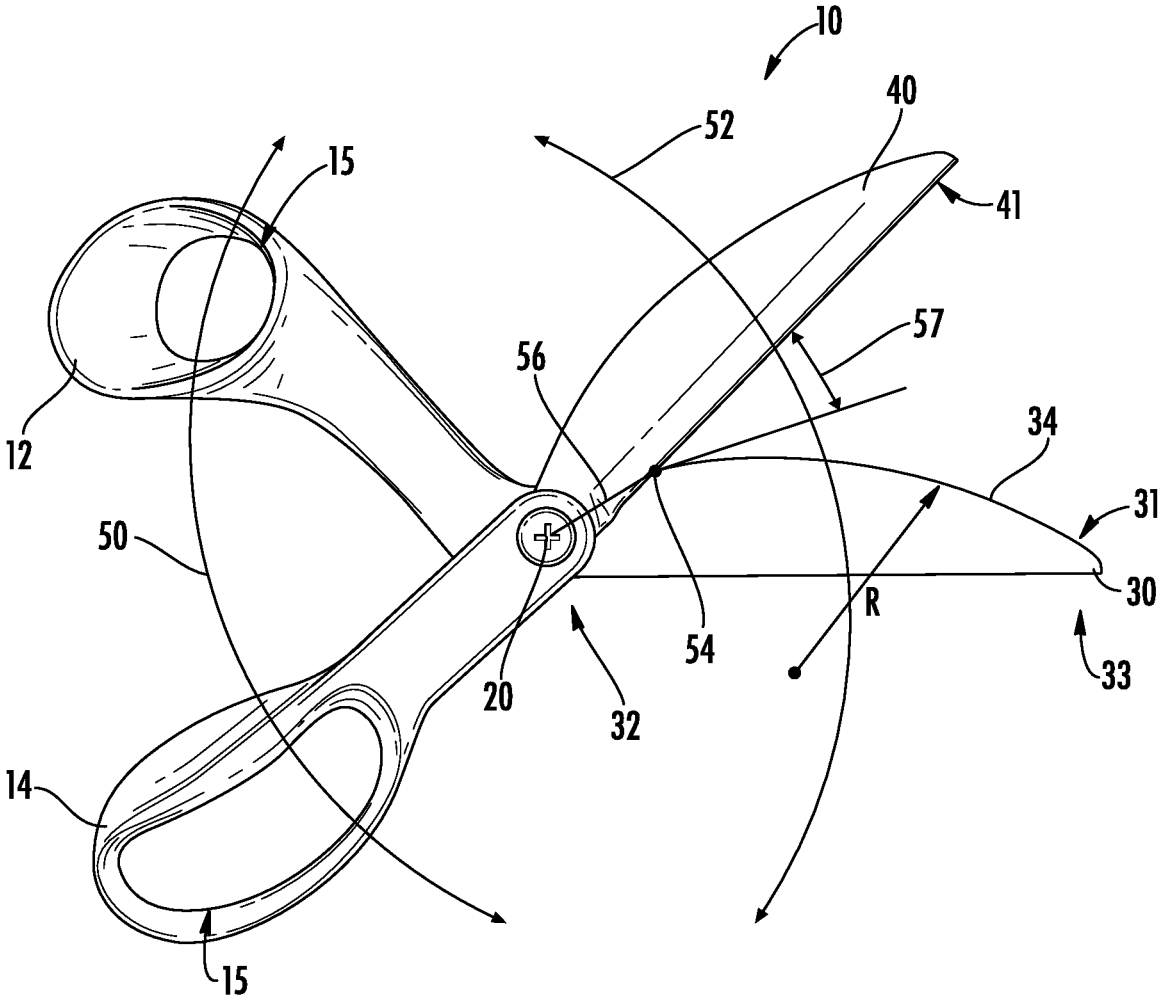
FIG. 1 is a schematic image of a one-hand operated cutting tool, such as a scissors, in a fully open position, according to an exemplary embodiment.

Referring to the Figures generally, various embodiments disclosed herein relate to a hand operated cutting tool (e.g., a scissors) with a relatively flatter cut force profile compared to conventional hand operated cutting tools. In this regard and as used herein, the term cut force profile (also referred to as the cutting force profile) refers to the cut force required to cut through an object as the jaws or cutting members of the tool are actuated from fully open to fully close (i.e., from a point of maximum separation to minimum separation). For example, in a conventional hand operated scissors, a force required to cut through an object increases as the cut position moves towards a tip of the scissors (i.e., as the handles of the scissors travel from the fully open position to a fully closed position). Such an increase in force may reduce ease of use and frustrate users. This problem may be compounded due to the typically small size of scissors, which makes implementation of a mechanical advantage mechanism difficult.

According to the present disclosure, a hand operated cutting tool, such as a scissors, may be provided with first and second cutting members that are coupled to first and second handles, respectively. At least one of the first and second cutting members may include a cutting device (e.g., a blade, serrated blade, etc.) having a crescent or bow-shaped cutting profile. Applicants have determined that such a profile may accelerate a cut-point position (i.e., a region where the cut is occurring) as the handles move from the fully open position to the fully closed position and to decelerate proximate the fully closed position of the tool. As a result, the cut force profile remains relatively flat and substantially without a parabolic increase like conventional tools. Advantageously, a mechanical advantage is provided relative to conventional systems, and users of the tool may experience a relatively easier ability to cut objects, which may increase an endurance of the user with the tool. Moreover, the relatively flatter cut force profile may be achieved without implementing complex mechanical advantage mechanisms, which in turn may make fabrication and assembly of the hand operated cutting tools of the present disclosure more efficient and cost effective. Further, the relatively flatter cut force profile may provide an increased amount of control over the tool to, in turn, provide enhanced accuracy and precision to users. These and other features and advantages are described more fully herein.

It should be understood that while the present disclosure is primarily described herein in regard to scissors and shears as hand operated cutting tools, the present disclosure contemplates implementation with other hand operated cutting tools. For example, the present disclosure may also be implemented with a pruner, a snip, and so on. Moreover, while the present disclosure is also described mainly in regard to one-hand operated cutting tools, the present disclosure may also be implemented with two-hand operated cutting tools (e.g., hedge shears). All such variations are intended to fall within the scope of the present disclosure. Moreover, as referred to herein, the object of a cutting tool may preferably refer to sheet goods (e.g., a sheet of paper, a sheet of cardboard, etc.), where there may be a consistent cut-force required along a length of the tool. However, such an application is not meant to be limiting as the object of the cutting tool may also include a wide variety of objects, such as branches, twigs, weeds, small trees, etc.

Referring now to FIG. 1, a one-hand operated cutting tool is shown as a scissors 10, according to one embodiment. The scissors 10 includes a first handle 12 coupled to a first cutting member 30 and a second handle 14 coupled to a second cutting member 40. The handles 12, 14 may define a user interface portion for the scissors 10. In the example shown, the handles 12, 14 define holes 15 (e.g., openings, voids, apertures), where the holes 15 may receive one or more fingers of the hand of the user operating the scissors. For example, a user may place a thumb into the hole 15 defined by the first handle 12 and both of his/her middle and pointer fingers into the hole 15 defined by the second handle 14.

As described below, moving the handles 12, 14 closer to and further from each other actuates a closing and an opening of the cutting members 30, 40, where movement from the fully open to the fully closed position corresponds with a cutting a stroke of the scissors 10. In this regard, the cutting stroke is characterized by the cutting of the scissors 10 occurring or being able to occur. In one embodiment, each of the coupled first handle 12 and first cutting member 30 and the second handle 14 and second cutting member 40 are of unitary or integral construction. For example, each of the coupled first handle 12 and first cutting member 30 and second handle 14 and second cutting member 40 may be formed from a cast metal (e.g., aluminum) where an over-molded portion (e.g., rubber) is applied to each handle portion 12, 14 to define an ergonomic user interface portion. According to another embodiment, each of the coupled first handle 12 and first cutting member 30 and the second handle 14 and second cutting member 40 are constructed from two or more components. For example, each handle 12, 14 may be a first component that is coupled to each of the first and second cutting members 30, 40, respectively, via, for example, one or more fasteners (e.g., a bolt) or another joining process (e.g., an interference relationship, welding, etc.). In yet another example, one of the coupled handles and cutting members may be of unitary construction while the other coupled handle and cutting member is constructed from two or more components. All such variations are intended to fall within the scope of the present disclosure.

As shown, the first handle 12 and first cutting member 30 are pivotably coupled to the second handle 14 and second cutting member 40 at a pivot connection 20. The pivot connection 20 may include any type of pivot connection including, but not limited to, a bolt, a pin, a lug, a rivet, a stud, and so on. In use, the handles 12, 14 and cutting members 30, 40 rotate about the pivot connection 20 during operation of the scissors 10. Further, while the pivot connection 20 is illustrated as stationary or fixed, this depiction is for illustrative purposes only. In other embodiments, the pivot connection 20 may be structured as a compound action type pivot connection. The compound action type connection may include a sliding joint. For example, an elongated aperture defined in each of the cutting members may receive a pivot member (e.g., bolt, pin, etc.), where the pivot member may slide or move within the elongated aperture. The sliding joint may be used to change the relative positioning of one cutting member to the other cutting member. The compound action type connection may also include a sliding joint with ridges or catches within the elongated apertures, where the ridges or catches facilitate the catching of the pivot member to lock or substantially lock a desired relative positioning of each cutting member. Accordingly, the term pivot connection is meant to be broadly interpreted to correspond with a variety of different types of pivot connections.

The first cutting member 30 is shown to include a first cutting device 31, while the second cutting member 40 includes a second cutting device 41. As shown, the first and second cutting devices 31, 41 are structured as cooperating blades that engage with each other in a shearing relationship to cut through an object. In other embodiments, at least one of the first and second cutting devices 31, 41 may be structured as any other cutting device including, but not limited to, a serrated or toothed edge, an anvil (e.g., a relatively flat or blunt edge that may cooperate with a blade or other cutting device to effect cutting through an object), etc.

As shown, the first cutting member 30 includes a first end 32 proximate the pivot connection 20 and a second end 33 (e.g., the tip of the cutting member 30) furthest from the pivot connection 20. Between the ends 32, 33, the cutting device 31 may define a convex or bow-shape profile 34 (e.g., crescent shaped, arched, etc.), where the convex nature is based on the orientation of the cutting device 31 relative to the object being cut. It is important to note that while the cutting device 31 (and/or cutting device 41) may define a bow-shaped profile, the characteristics of the cut or shear produced by the cutting tool (e.g., scissors 10) on the object remain unchanged or substantially unchanged. For example, the cut line on the object (e.g., a sheet of paper) is still dictated by the user by, e.g., rotating and/or turning the tool.

Accordingly, the bow-shaped profile 34 refers to the shape/configuration of the cutting device and not the object cut characteristics, such that the bow-shaped profile 34 may advantageously still produce the same or substantially the same object cut characteristics.

The profile 34 may have a variety of radii of curvature, R. According to one embodiment, the radius of curvature, R, is convex-shaped relative to the object of the scissors 10 (i.e., the sides surrounding the peak or crest of the profile slope away from the object when the object is inserted between the two cutting devices). In this regard and as shown, the bow-shaped profile 34 may be characterized by a peak or crest in or around the middle of the cutting device 31 (e.g., substantially in between the first end 32 and the second end 33) with the sides of the cutting device 31 sloping away from the peak or crest toward each of the first and second ends 32, 33 respectively. According to one embodiment, the profile 34 corresponds with a polynomial function. In one instance, polynomial function may correspond with a quadratic curve corresponding with the convex-shaped profile, which is shown in the example depicted.

In the example depicted, an asymmetric cutting device configuration is depicted. In this regard, only one cutting device of the two cutting devices is shown to include a bow-shaped cutting profile (hence, asymmetric). In other embodiments (see FIG. 9), both of the cutting devices may define bow-shaped cutting profiles. In this regard, if the bow-shaped cutting profile were implemented with the second cutting member 40, the cutting device 41 would define a concave cutting profile with respect to the cut orientation on the object. Applicants have determined that a relatively flatter cut force may be achieved when at least one of the cutting devices define a bow-shaped profile. Accordingly, both such variations are intended to fall within the scope of the present disclosure. Explanation of achievement of the relatively flatter cut force may be explained with reference to FIGS. 2-8.

Figure 2:
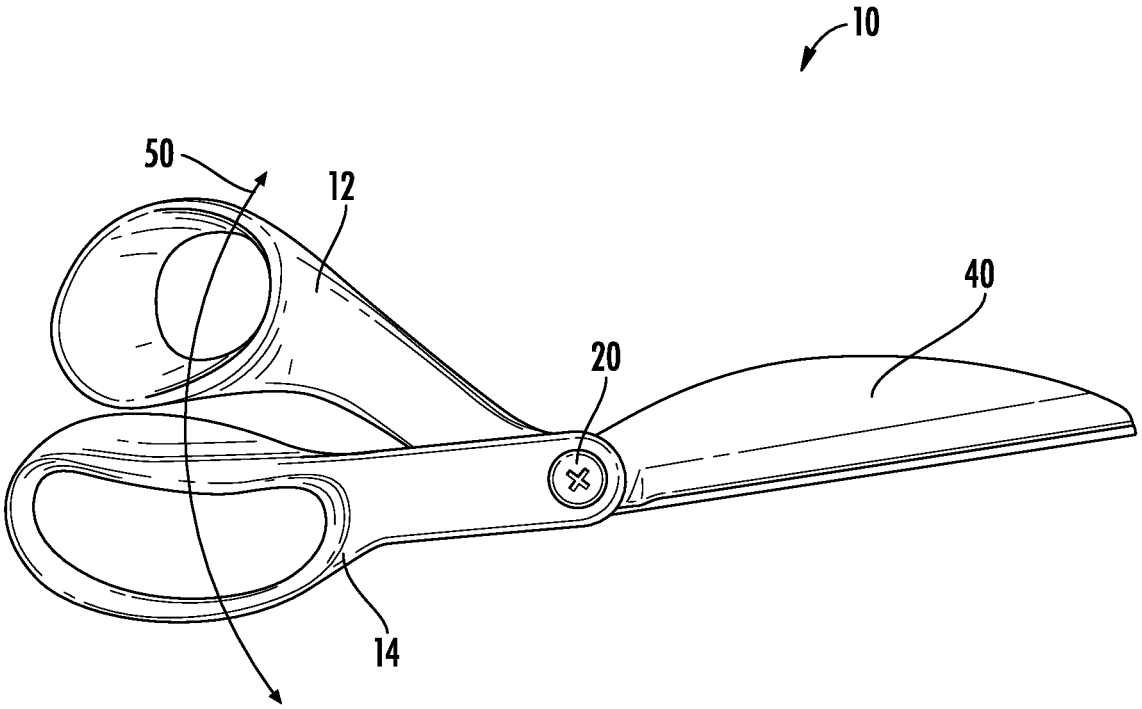
FIG. 2 is a schematic image of the one-hand operated cutting tool of FIG. 1 in a fully closed position.

A fully open handle position for the scissors 10 is shown in FIG. 1 while FIG. 2 depicts a fully closed handle position for the scissors 10. A fully open position is characterized by the handles 12, 14 being at a maximum separation distance and angle 50. A fully closed position is characterized by the handles 12, 14 being at a minimum separation distance and angle 50. According to one embodiment, the handles 12, 14 have a total angular motion of approximately thirty-five (35) degrees, where approximately refers to +/−two (2) degrees or any other definition used by those of ordinary skill in the art. A fully open position is also characterized by a maximum separation distance and angle 52 of the cutting devices 31, 41 (and, consequently, cutting members 30, 40). A fully closed position is characterized by a minimum separation distance and angle 52 of the cutting devices 31, 41.

Based on the above, the angle 50 may be referred to herein as the handle angle, which is indicative of the angle of separation between the handles 12, 14. According to one embodiment, the handle angle 50 may be defined as the intersection angle between a first line defined by an end point at the pivot point 20 and a fixed point on the handle 12 and a second line defined by an end point at the pivot point 20 and a fixed point on the handle 14. In this regard, each of the first and second lines share a common point to define an intersection location at the pivot point 20. In this embodiment, the fixed points on each of the handles 12 and 14 for each of the first and second lines may be positioned in any desired position. For example, the fixed points may be positioned at an approximate mid-point of the width of the handles 12 and 14 where the "width" refers to the area of the handles 12, 14 shown in FIG. 1 (e.g., the front view of the scissors 10 that allows one to see through the apertures 15 whereas a top or bottom view of the scissors 10 would provide a view orthogonal to the apertures 15). In another example, the fixed points for each of the lines on the handles 12, 14 may be in any other location. According to another embodiment, the handle angle 50 may be defined by any suitable definition by those of ordinary skill in the art used to refer to the separation angle between the handles 12 and 14. In comparison, the angle 52 may be referred to herein as the "bulk blade angle" or "bulk blade opening angle." Accordingly, as will be appreciated by those of ordinary skill in the art, the phrase "bulk blade angle" and "bulk blade opening angle" is intended to cover cutting tools including and not including integrated mechanical advantage devices. In this regard, the "bulk blade angle" refers to and is indicative of the angle between the first and second cutting members 30 and 40.

The bulk blade opening angle 52 may be defined by any suitable definition accepted by those of ordinary skill in the art. For example, according to one embodiment, the bulk blade opening angle 52 may be defined as the angle between a first line defined by an end point at the pivot point 20 and a fixed point on the first cutting member 30 and a second line defined by an end point at the pivot point 20 and a fixed point on the second cutting member 40. According to another embodiment, the bulk blade opening angle 52 may be defined in any other manner. All such variations are intended to fall within the scope of the present disclosure. Finally, the angle 57 may be referred to herein as the "cutting device angle" or "cutting edge angle" and refers to the angle of separation between an edge of the first cutting device 31 and an edge of the second cutting device 41 at the cut-point 54 (i.e., the angle between the cutting devices 31 and 41 where the actual cut is occurring or about to occur). The cut-point 54 refers to the intersection of the cutting devices 31 and 41 that cause the shear and cutting of the object (i.e., where the cutting devices 31, 41 engage or are about to engage with the object to cause the cutting or shearing of the object). In this regard and as shown, the angle 57 may be different from the angle 52.

In operation, as the handles 12, 14 travel from a fully open position to a fully closed position, the angles 50 and 52 decrease and the cut-point 54 moves towards the second end 33. Similarly, a distance 56 between the pivot connection 20 and the cut-point 54 increases during movement of the handles 12, 14 towards the fully closed position.

Applicants have determined that based in part on the bow-shaped profile of the cutting device, such as cutting device 31, a speed of the cut-point 54 may be increased to facilitate a faster cut with relatively less force. This and other characteristics of the present disclosure may be described and shown with reference to FIGS. 3-8. In FIGS. 3-8, characteristics of the scissors 10 are depicted alongside conventional scissors. The characteristics of the scissors 10 of the present disclosure are shown in curves 301, 401, 501, 601, 701, and 801, while the characteristics of the conventional scissors are shown in curves 302, 402, 502, 602, 702, and 802. FIGS. 3-8 represent simulation evidence determined by the Applicants. It should be understood that while FIGS. 3-8 are based on hand operated cutting tools configured as scissors, similar characteristics may also achieved with other hand operated cutting tools, such as pruners, shears, or snips. Accordingly, FIGS. 3-8 are not meant to be limiting to hand operated scissors.

Figure 3:
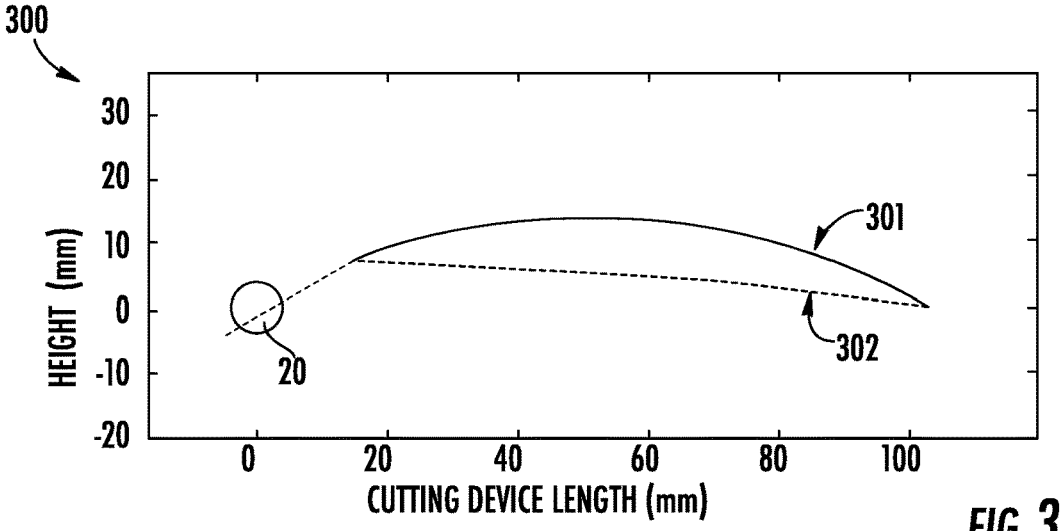
FIG. 3 is a graphical representation of a bow-shaped cutting profile compared to a straight or planar cutting profile for a hand operated cutting tool, according to an exemplary embodiment.

Referring now to FIG. 3, a graph 300 depicting a cutting device profile of the scissors 10 alongside a conventional scissors is shown, according to one embodiment. The graph 300 illustrates a profile 302 of conventional scissors blades (i.e., cutting devices) relative to a pivot connection 20 alongside a profile 301 of a cutting device of the present disclosure, such as cutting device 31 of FIGS. 1-2. As shown, the cutting device length corresponding with the profile 301 is substantially similar to the cutting device length corresponding with the profile 302, where substantially may refer to +/−three (3) millimeters, +/−five (5) percent of the total length of the cutting device, and/or any other accepted definitional term by those of ordinary skill in art. However, in contrast to the conventional profile 302 and for substantially the same length, the height of the profile 301 is relatively greater to correspond with the bow or arch shape profile of the cutting device (e.g., profile 34). As shown in more detail in FIGS. 4-8, the profile 301 causes or at least is a cause of various advantageous characteristics of the hand operated cutting tool of the present disclosure.

Figure 4:
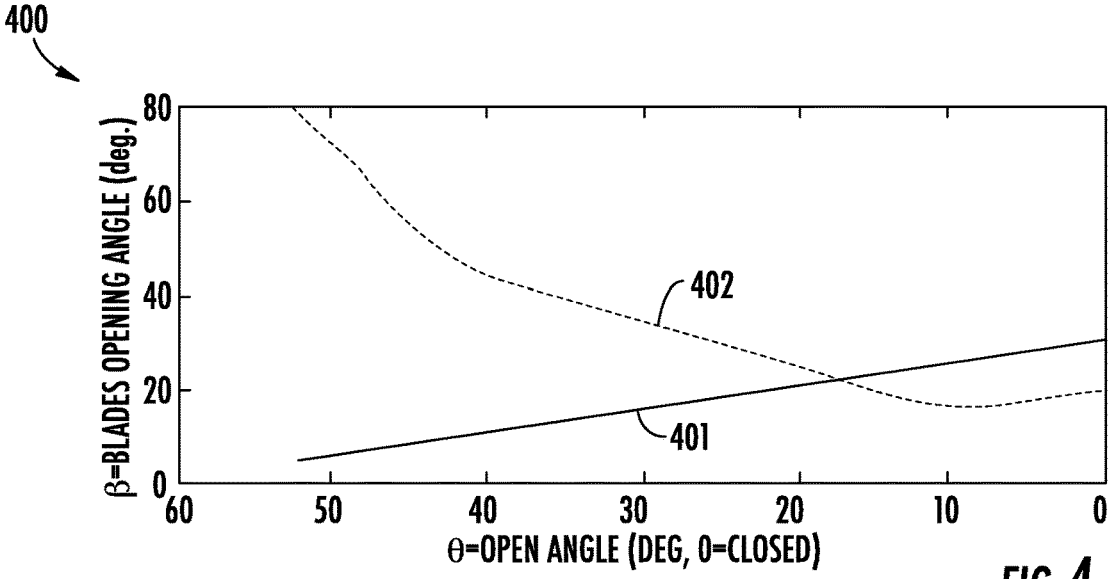
FIG. 4 is a graphical representation of a cutting edge angle at the cut point as a function of bulk blade opening angle for a hand operated cutting tool with a bow-shaped cutting profile alongside a hand operated cutting tool without a bow-shaped cutting profile, according to an exemplary embodiment.

Referring now to FIG. 4, a graph 400 of cutting edge angle as a function of bulk blade opening angle for a conventional cutting device profile (curve 402) relative to a cutting device profile of the present disclosure (curve 401) is shown, according to one embodiment. As shown, as the bulk blade angle (e.g., angle 52 corresponding to the y-axis of graph 400) opening moves from a full or a nearly fully open position (e.g., approximately eighty (80) degrees) towards a fully closed position, the curve 402 corresponds with the cutting edge angle decreasing severely in an almost exponential fashion. In contrast, the curve 401 for the cutting device profile of the present disclosure and corresponding to the cutting edge angle 57 increases substantially linearly as the bulk blade opening angle 52 moves towards a fully closed position. As used herein, "substantially" as the term is used to describe linearity refers to the curve being approximated by a first-order mathematical relationship, a coefficient of determination (e.g., an R-squared value) being above a predefined threshold (e.g., eighty (80) percent) for a linear line of best fit fitting the data, and/or any other way interpreted to be substantially linear by those of ordinary skill in the art. By increasing a cutting edge angle (i.e., reference numeral 57 in FIG. 1) as the bulk blade opening angle (i.e., reference numeral 52 in FIG. 1) decreases, relatively more force may be applied at the end of the cut (i.e., proximate the tip or second end 33), which may reduce the strain exerted by the user to make final cut through the object. A graphical illustration of this advantageous effect is shown in FIGS. 6-7.

It should be understood that while the cutting edge angle versus the bulk blade opening angle (curve 401) is shown to be linear or substantially linear, the present disclosure contemplates that a non-linear relationship may be created or formed between the cutting edge angle and the bulk blade opening angle. In this regard, the linear or substantially linear relationship is not meant to be limiting. In particularity, Applicants have determined that to create a perfectly flat cut force profile, the relationship would be non-linear in nature (e.g., correspond with an exponential or polynomial increasing function where the cutting edge angle increases based on that function as the bulk blade angle decreases).

Figure 5:
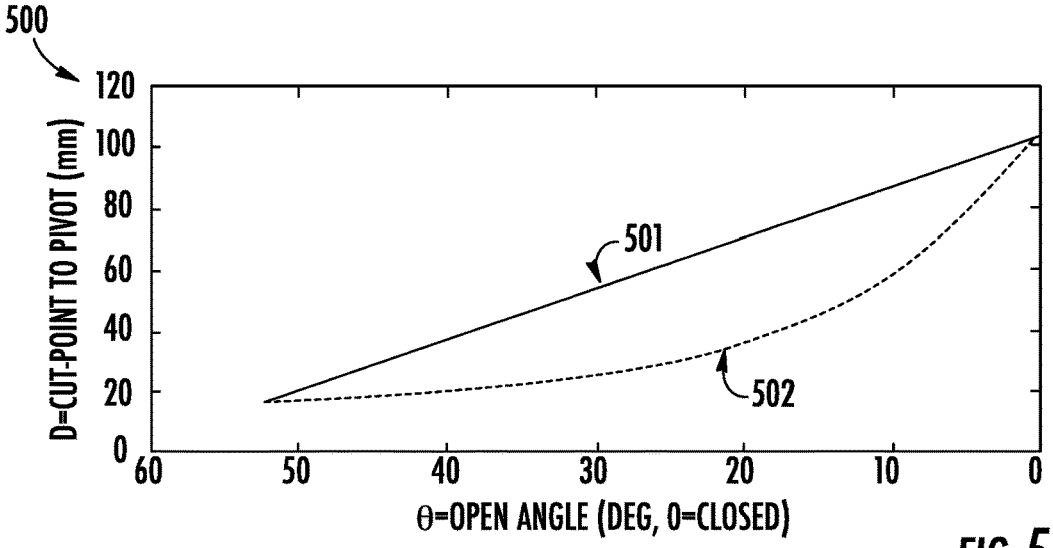
FIG. 5 is a graphical representation of a cut-point position to pivot connection distance as a function of cutting edge angle for a hand operated cutting tool with a bow-shaped cutting profile alongside a hand operated cutting tool without a bow-shaped cutting profile, according to an exemplary embodiment.

Referring now to FIG. 5, a graph 500 of a cut-point position relative to pivot connection as a function of cutting edge angle is shown for a cutting device profile 501 of the present disclosure versus a conventional cutting device profile 502, according to one embodiment. With reference to FIG. 1, the cut-point position relative to the pivot connection is shown as reference numeral 54 while the cutting edge angle is shown as reference numeral 57. As shown in FIG. 5, as the handles move from a full or nearly fully open position towards a fully closed position, the curve 501 is longer (i.e., greater, more distance, etc.) than the curve 502. In other words, for the same cutting edge angle, the curve 501 corresponds with a greater cut-point to pivot distance than the curve 502. Further, as shown, the curve 502 is fairly slow in increasing the distance between the cut-point position and the pivot connection until the cutting devices are nearly closed (approximately fifteen (15) degrees in graph 500). As a result, a relatively non-linear relationship is depicted by the curve 502. Such non-linearity may reduce a feel of uniformity of the cut force required for the user. In comparison, the curve 501 depicts a substantially linear relationship between cutting edge angle and the distance between the cut-point relative to the pivot connection. As at least partly a result of this linearity, the cut-point position relative to the pivot connection may be thought of accelerating relative to the conventional cutting devices. Beneficially, users may advance the cutting members relatively more quickly through the object.

Figure 6:
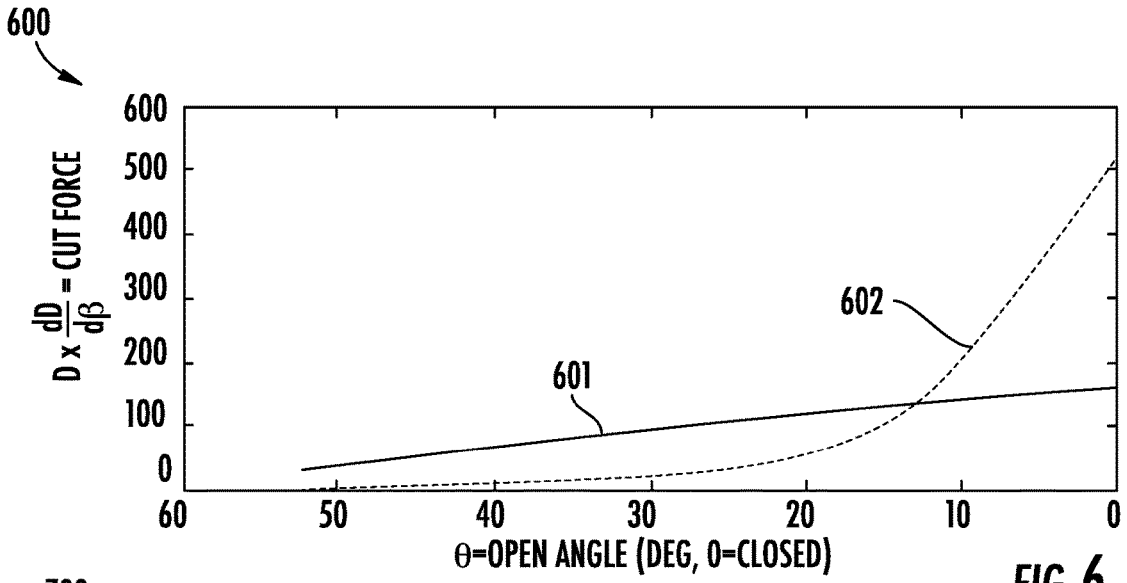
FIG. 6 is a graphical representation of a cut force as a function of a cutting edge angle for a hand operated cutting tool with a bow-shaped cutting profile alongside a hand operated cutting tool without a bow-shaped cutting profile, according to an exemplary embodiment.
Figure 7:
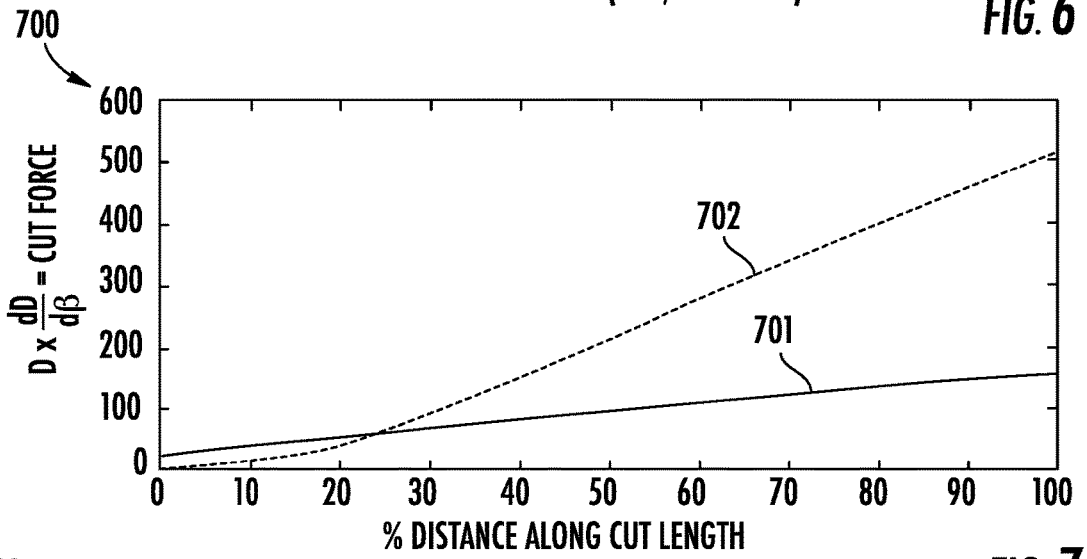
FIG. 7 is a graphical representation of a cut force as a function of a distance along a cut length for a hand operated cutting tool with a bow-shaped cutting profile alongside a hand operated cutting tool without a bow-shaped cutting profile, according to an exemplary embodiment.
Figure 8:
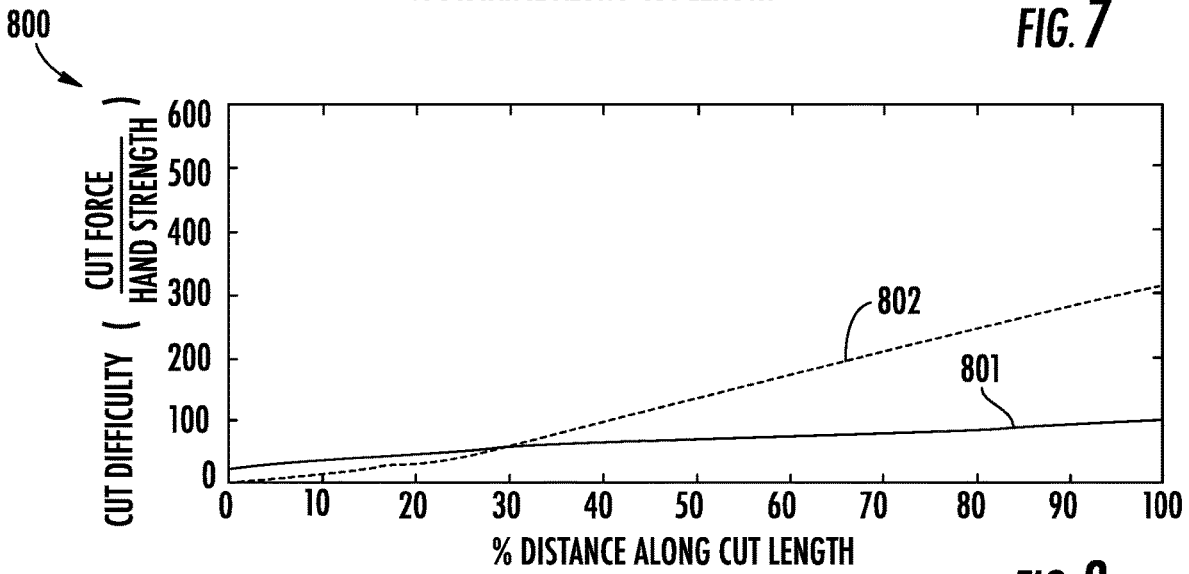
FIG. 8 is a graphical representation of a cut difficulty as a function of distance along a cut length for a hand operated cutting tool with a bow-shaped cutting profile alongside a hand operated cutting tool without a bow-shaped cutting profile, according to an exemplary embodiment.

Accordingly, referring to FIG. 6, a graph 600 of cut force versus cutting edge angle for a conventional cutting device profile (curve 602) relative to a cutting device profile of the present disclosure (curve 601) is shown, according to one embodiment. The cut force may be determined using equation (1), as described below with reference to FIG. 7. As shown, the cut force required near the fully closed position (approximately fifteen (15) degrees) for the conventional cutting device (curve 602) increases almost exponentially. Such an increase may be felt as an uncomfortable hitch in the cutting stroke for the user. In comparison and advantageously, the cut force required as a function of cutting edge angle for the cutting device of the present disclosure (curve 601) remains substantially linear and increases only slightly as the cutting edge angle moves towards the fully closed position. In turn, a relatively flatter cut force profile is obtained. As shown in FIG. 8, this characteristic may result in a relatively lower cut force difficulty experienced by the user.

Referring to FIG. 7, a graph 700 of the cut force versus a distance along a length of the cut for a conventional cutting device profile (curve 702) relative to a cutting device profile of the present disclosure (curve 701) is shown, according to one embodiment. In this example, the cut force may be defined according to the following equation:

$$\text{Cut Force} = D \times \frac{dD}{d\beta} \tag{1}$$

In equation (1), "D" refers to the distance between the pivot connection 20 and the cut-point 54 (i.e., reference number 56 in FIG. 1) and β refers the bulk blade opening angle (i.e., reference numeral 52 in FIG. 1). Relative to the curve 702, the curve 701 remains substantially flat. As shown, the curve 702 includes a spike or large increase in the cut force required to cut through the object around twenty-five (25) percent of the cut length. Beneficially, the curve 701 is without any large cut force spikes to maintain a relatively flatter cut force profile. Accordingly and advantageously, a user of the cutting device of the present disclosure may experience a relatively more uniform force requirement throughout the cut. Further, the user may also have a feeling that the force to use the hand operated cutting tool is relatively easier than other hand operated cutting tools. This may increase the appeal of the hand operated cutting tool of the present disclosure relative to other hand operated cutting tools.

Referring now to FIG. 8, a graph 800 of cut force difficulty as a function of distance along the length of the cut (as a percentage) for a conventional cutting device profile (curve 802) relative to a cutting device profile of the present disclosure (curve 801) is shown, according to one embodiment. While many different relationships, formulas, algorithms, etc. may be used to characterize the cut for difficulty, Applicants have used equation (2) below. This formula is not meant to be limiting as other and different types of representations may also be used.

$$\text{Cut Difficulty} = \frac{\text{Cut Force}}{\text{Hand Strength}} \tag{2}$$

In equation (2), the "cut force" term may be measured (e.g., via one or more strain or force gauges) or otherwise determined (e.g., estimated) and may refer to/be indicative of the force to operate the cutting tool to cut through/shear an object. Of course, the cut force for different objects may vary (e.g., cardboard versus paper); in this simulation, the object is unchanged to eliminate or substantially reduce any variability with respect to the simulated cut force. The term "hand strength" may represent a user's hand strength (e.g., a squeeze strength as represented by the tightness of a fist a user can make) as a function of position (e.g., from the full open position to the full close position). This may be a measured, predicted, or estimated term. As shown, first, the curve 801 is relatively flat compared to the curve 802. Second, the curve 801 does not include a spike in difficulty like that shown in the curve 802 around twenty-five (25) percent cut length. Thus, relatively less difficulty may be experienced by the user of the cutting tool of the present disclosure.

As shown in FIGS. 3-8, the cutting device profile of the present disclosure facilitates reduced cut force requirements throughout a distance of the cut of an object. Such a characteristic may make the cutting tool of the present disclosure easier to use, more comfortable to use, and more enjoyable to use. As mentioned above, the cutting device profile may be used with both cutting members of a scissors and with other hand operated cutting tools.

Figure 9:
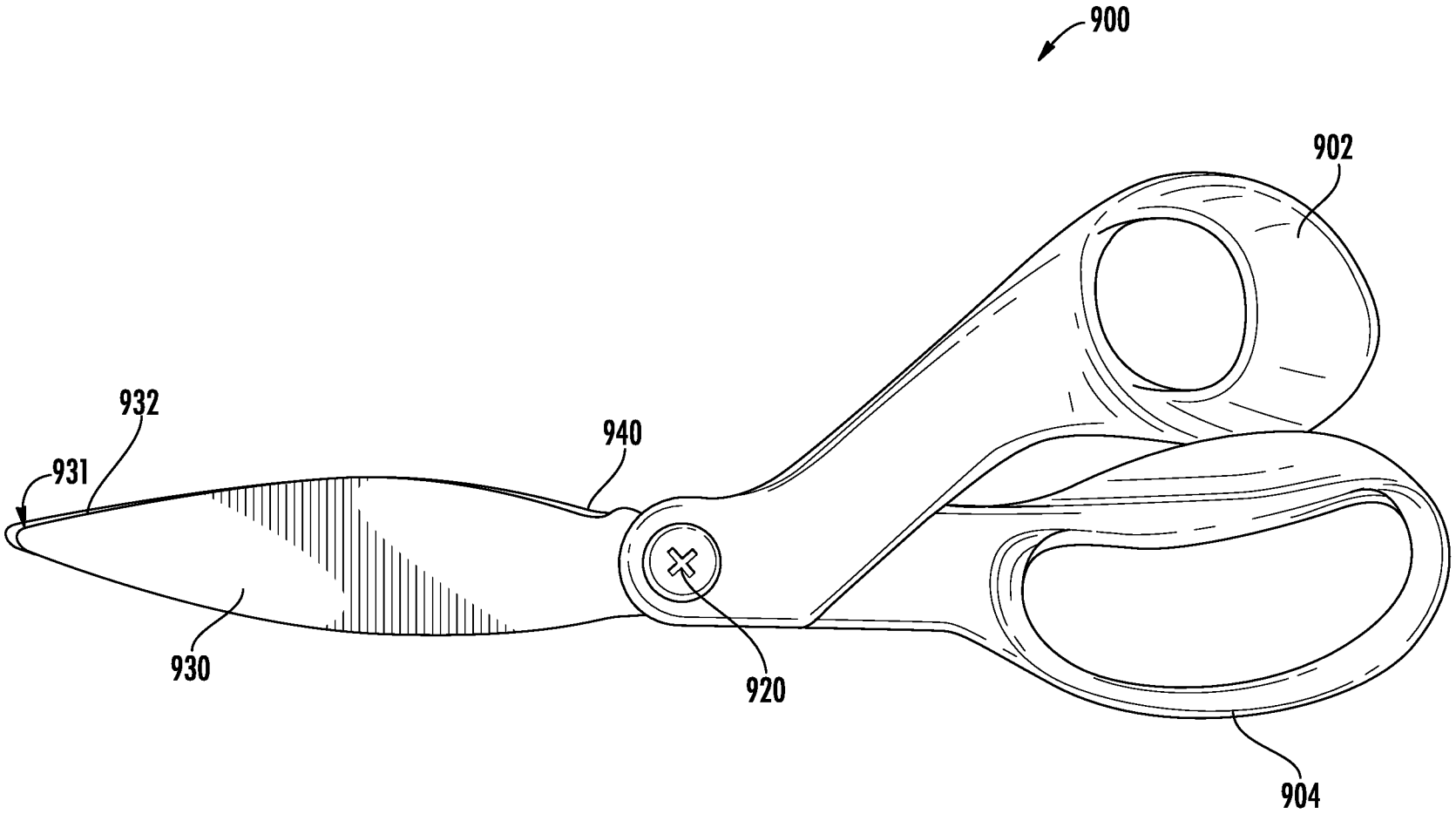
FIG. 9 is a schematic image of a one-hand operated cutting tool, such as a scissors, in a fully closed position, according to another exemplary embodiment.

FIG. 9 depicts a one-hand operated cutting tool, namely scissors 900, according to one embodiment. The scissors 900 may be substantially similar to the scissors 10 in that the scissors 900 includes a first handle 902 coupled to a first cutting member 930 and a second handle 904 coupled to a second cutting member 940, where the first and second handles 902, 904 and the first and second cutting members 930, 940 are rotatable about a pivot connection 920 (e.g., a pin, a lug, a rivet, a bolt, etc.).

However, in this embodiment and relative to the scissors 10, the scissors 900 is shown to include symmetric cutting members 930, 940. In this regard, symmetric indicates that each cutting member includes a bow-shaped cutting device. As shown, the first cutting member 930 includes a first cutting device 931 (a cutting device of the second cutting member 940 is hidden by the first cutting member 930 in FIG. 9). The first cutting device 931 may include any type of cutting device such as a blade, toothed edge, serrated edge, etc. and is shown to include a profile 932. The profile 932 may be bow, arched, or otherwise crescent-shaped like the cutting device profiles of FIGS. 1-2. In this regard, the bow-shaped profile 932 may correspond with the bow-shaped profile 34 of FIG. 1 or include more or less bow-shape than the profile 34. Applicants have determined that increasing the bow-shape increases the acceleration of the cut-point position to yield a relatively flatter cut-force profile. As mentioned above, the bow-shaped profile 34 is characterized by having a peak or crest near a middle portion of the cutting member 930 and the sides of the cutting device 931 surrounding the crest or peak angle away towards a tip of the cutting device and the pivot connection 920, respectively.

As mentioned above, FIG. 9 depicts a symmetric embodiment of the cutting device profiles for a hand operated cutting tool. This embodiment has the advantage of potentially reducing the number of parts to produce the hand operated cutting tool because the cutting members may be mirror images of one another. More particularly, each cutting member may be identical components (i.e., identical in structure), where one of the cutting members is rotated one-hundred eighty (180) degrees relative to the other cutting member. As an added result, such a reduction in part numbers may reduce the assembly complexity of the tool.

Figure 10:
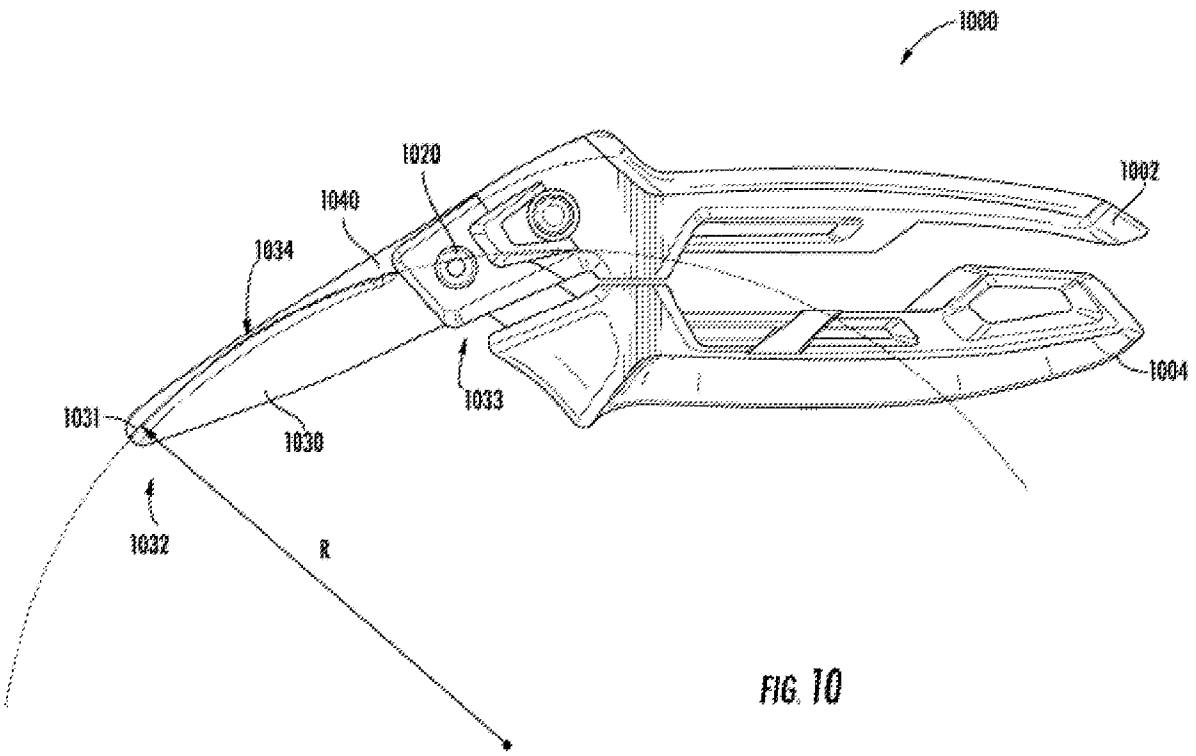
FIG. 10 is a schematic image of a one-hand operated cutting tool, such as a shears, in a fully closed position, according to an exemplary embodiment.

While FIGS. 1-2 and 9 have shown the hand operated cutting tool as a scissors, FIG. 10 shows a one-hand operated cutting tool in the form of shears 1000, according to one embodiment. The shears 1000 includes a first handle 1002 coupled to a first cutting member 1030 and a second handle 1004 coupled to a second cutting member 1040. Like the scissors 10, the handles 1002, 1004 of the shears 1000 define a user interface portion. In this regard, the handles 1002, 1004 may have the same or similar characteristics as the handles 12, 14. In this regard, the handles 1002, 1004 may be constructed from one or more components (e.g., composites and rubbers to add ergonomics) and be sized and shaped in a variety of different of arrangements.

Like the scissors of FIGS. 1-2, the shears 1000 is shown to have asymmetrical cutting devices 1030, 1040. In this regard, only the first cutting member 1030 is shown to include a bow-shaped cutting profile. However, in other embodiments, both cutting members 1030, 1040 may include bow-shaped cutting profiles. Relative to the bow-shaped profile 34 of FIG. 1, the bow-shaped profile 1034 of the first cutting device 1031 is relatively smaller (e.g., less of a bow), which corresponds with a larger radius of curvature, R. However, this is exemplary only as other radii of curvature, R, may be used. Nonetheless, a peak or crest of the bow-shape may be found approximately half-way between a first end 1032 of the cutting member 1030 and a second end 1033 of the cutting member, where the second end 1033 is proximate the pivot connect 1020. Applicants have determined that the bow-shaped profile 1034 of the cutting device 1031 facilitates a relatively faster cutting characteristic and corresponds with a relatively flatter cut force characteristic through the length of the cut as compared to conventional shears. In turn, the bow-shaped profile 1034 may provide additional accuracy and precision to a user of the tool.

According to one embodiment, the cutting members 1030, 1040 may be constructed from a metal-based material (e.g., stainless steel). In other embodiments, the cutting members 1030, 1040 may be constructed from any material that may be used with or contemplated for use with a shears. All such variations are intended to fall within the scope of the present disclosure.

It is important to note that the construction and arrangement of the elements of the hand operated cutting tool, shown as a scissors and a shears, is illustrative only.

Although only a few embodiments have been described in detail in this disclosure, those skilled in the art who review this disclosure will readily appreciate that many modifications are possible without materially departing from the novel teachings and advantages of the subject matter recited.

Accordingly, all such modifications are intended to be included within the scope of the present disclosure. Other substitutions, modifications, changes and omissions may be made in the design, operating conditions and arrangement of the preferred and other exemplary embodiments without departing from the spirit of the present disclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

For the purpose of this disclosure, the term "coupled" means the joining of two members directly or indirectly to one another. Such joining may be stationary or movable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present disclosure as expressed in the appended claims.

What is claimed is:

1. A hand operated cutting tool, comprising:

a first cutting member with a first cutting edge;

a first handle coupled to the first cutting member;

a second handle coupled to a second cutting member with a second cutting edge; and a pivot connection pivotably coupling the first handle to the second handle;

wherein the first and second cutting edges provide a cut-point position at a location where the first and second cutting edges interact, the first cutting edge defines a first convex bow-shaped cutting profile and the second cutting edge defines a second convex bow-shaped cutting profile, such that due to the shape of the first convex bow-shaped cutting profile and the second convex bow-shaped cutting profile, a cutting edge angle between the first and second cutting edges at the cut-point position increases throughout a movement when the first and second handles move from a fully open position to a fully closed position to facilitate an acceleration of the cut-point position, and a cut force profile of the hand operated cutting tool which is substantially linear throughout movement of the first and second handles from the fully open position to the fully closed position.

2. The hand operated cutting tool of claim 1, wherein a substantially linear relationship exists for the cutting edge angle between the first and second cutting members at the cut-point position as a function of bulk blade opening angle as the first and second handles move from the fully open position to the fully closed position.

3. The hand operated cutting tool of claim 1, wherein a substantially linear relationship exists for a distance between the cut-point position and the pivot connection as a function of an angle between the first and second cutting members at the cut-point position as the first and second handles move from the fully open position to the fully closed position.

4. The hand operated cutting tool of claim 1, wherein the second convex bow-shaped cutting profile matches the first convex bow-shaped cutting profile.

5. The hand operated cutting tool of claim 1, wherein the hand operated cutting tool includes one of a scissors and a shears.

6. The hand operated cutting tool of claim 1, wherein movement of the first and second handles from the fully open position to the fully closed position corresponds with approximately thirty-five degrees of angular motion.

7. The hand operated cutting tool of claim 1, wherein the second convex bow-shaped cutting profile corresponds with a different radius of curvature than the first convex bow-shaped cutting profile.

* * * * *